United States Patent [19]

Aono et al.

[11] 4,199,641

[45] Apr. 22, 1980

[54] COVERING FILM FOR CASTING PROCESS BY VACUUM SEALED MOLDING

[75] Inventors: Syunji Aono; Atsushi Toyoda, both of Hamamatsu, Japan

[73] Assignee: Nippon Gakki Seizo Kabushiki Kaisha, Japan

[21] Appl. No.: 953,018

[22] Filed: Oct. 20, 1978

[30] Foreign Application Priority Data

Oct. 21, 1977 [JP] Japan ..... 52/125787

[51] Int. Cl.[2] ..... B32B 7/02; B22C 9/12

[52] U.S. Cl. ..... 428/213; 106/38.22; 106/38.25; 164/33; 264/300; 264/338; 428/332

[58] Field of Search ..... 164/7, 33, 138, 47; 264/300, 316, 338; 106/38.22, 38.25; 428/212, 213, 332

[56] References Cited

U.S. PATENT DOCUMENTS

| | | | |
|---|---|---|---|
| 3,802,902 | 4/1974 | Turner et al. | 106/38.22 X |
| 3,880,949 | 4/1975 | Villa | 106/38.25 X |
| 4,043,376 | 8/1977 | Kasai et al. | 164/138 X |
| 4,088,808 | 5/1978 | Cornwell et al. | 264/338 X |

*Primary Examiner*—Thomas J. Herbert, Jr.

*Attorney, Agent, or Firm*—Ostrolenk, Faber, Gerb & Soffen

[57] ABSTRACT

A covering film containing a thermoplastic resin productive of burnt dregs and a thermoplastic resin not productive of burnt dregs moderately disperses in the refractory filler of the mold and forms a relatively thin shell layer near the wall defining the mold cavity in order to successfully avoid generation of mold destruction and sand inclusion and streamline the whole casting process.

8 Claims, 3 Drawing Figures

COVERING FILM FOR CASTING PROCESS BY VACUUM SEALED MOLDING

BACKGROUND OF THE INVENTION

The present invention relates to an improved covering film for casting process by vacuum sealed molding, and more particularly relates to an improvement in the composition of a covering film used for casting process by vacuum sealed molding.

The so-called casting process by vacuum sealed molding starts with preparation of a mold utilizing solidification of a refractory filler building up the mold by vacuum suction. At the starting of the molding operation, a heated thermoplastic resin film is brought into a snug surface contact with the pattern surface of an original pattern by application of vacuum suction. After mounting a corridor-type molding box in position on the original pattern, the refractory filler is charged into the center cavity of the molding box. When the center cavity is replete with the refractory filler, the top opening is closed by a separate sealing film and vacuum suction is applied to the refractory filled via the molding box in order to cause provisional solidification of the refractory filler. After the solidification is complete, the vacuum suction applied to the original pattern is cancelled and the latter is separated in order to obtain one mold half. In a substantially similar manner, the other mold half is obtained. The mold halves are firmly coupled to each other in order to obtain a complete mold having an internal mold cavity whose walls are tightly covered by the covering films. Molten metal is charged into the mold cavity under application of the vacuum suction to the mold and, after complete solidification of the charged metal, the vacuum suction is cancelled in order to disassemble the mold and obtain a cast product.

As the extremely high temperature molten metal is charged into the mold cavity in the above-described process, the covering films on the wall of the mold cavity melt and penetrate into the refractory filler due to the vacuum suction applied to the mold. In other words, the covering film disappears from the walls of the mold cavity which are then covered by the molten metal charged into the mold cavity.

In the case of a large mold cavity, the molten metal coming into the mold cavity first spreads over the bottom wall of the lower mold half and gradually increases in depth. That is, it takes rather a long period before the top of the molten metal reaches the top wall of the upper mold half. Due to this time lag, the covering film on the top wall of the upper mold half disappears due to the radiative heat from the rising top surface of the molten metal. This disappearance of the covering film tends to cause destruction of the upper mold half as the refractory filler is directly exposed in the mold cavity before contact with the molten metal charged into the mold cavity. This direct exposure of the refractory filler may take place on the side of the lower mold half also. Depending on the extent of the vacuum suction, granular size of the refractory filler and spreading speed of the molten metal, the covering film portions in the vicinity of the leading ends of the spreading molten metal melt and are sucked into the refractory filler so that the refractory filler is exposed in the mold cavity. Such exposure is liable to cause casting defects such as sand inclusion.

As the molten covering film is sucked into the refractory filler, the molten thermoplastic synthetic resin forms a shell layer together with the refractory filler. However, since the penetration speed of the molten resin is too large, the molten resin is dispersed over a wire area in the refractory filler at relatively low density. Such a low density of the dispersed molten resin naturally results in low bonding strength and low mechanical strength of the shell layer, thereby causing undesirable sand inclusion and texture degradation at charging of the molten metal.

As a solution to this problem, a new process has already been proposed by the U.S. Pat. No. 4,043,376. In the case of this proposed new process, the thermoplastic resin covering film sucked onto the original pattern is coated with a solution of an initial condensate of a thermositting resin to a thickness, preferably, in a range from 2 to 100 micronmeters in the solid state. After the coating, a molding box is mounted in position on the original pattern. The subsequent operations are substantially similar to those of the above-described conventional casting process.

When molten metal is charged into the mold cavity of the mold prepared by the above-mentioned new process, the initial condensate of the thermosetting resin located between the covering film and the refractory filler melts first due to heat of the charged molten metal and penetrates into the surface portion of the refractory filler near the mold cavity. This penetration of the thermosetting resin initial condensate forms a hardened layer in the above-described surface portion of the refractory filler and presence of such a hardened layer effectively prevents mold destruction and/or sand inclusion despite of advanced disappearance of the covering film on the cavity wall.

From the view point of reduction in casting defects, the merit of the above-described new process should be highly appreciated. However, it is inevitably accompanied by an undesirable operational complication in the molding process. That is, in order to assure appreciable covering characteristics, it is necessary to form a layer of the thermosetting resin initial condensate to a thickness, preferably, in a range from 2 to 100 micronmeters by solution coating. This solution coating is generally practiced by manual operation while using tools such as spray guns after the covering film is sucked onto the original pattern. Such a manual operation is particularly needed when the pattern surface of the original pattern is highly complicated in shape.

As is well known, spray of such a solution is unwelcome for the operators from the view point of labor hygienics. In addition, use of the refractory filler in the molding process is liable to generate powdery dust which is unsuited for manual operation. For these reasons, it is preferable to reduce manual operational steps in the vacuum sealed molding as much as possible and introduce mechanization of the whole process. Thus, requirement for the manual operation in the above-described coating step forms a great bar to streamlining the whole process by mechanization and automation of the operational steps. Solution coating by manual operation also tends to result in uneveness in thickness of the coated layer. Further, very complicated shapes of the pattern surface makes it difficult to carry out the coating operation even by spray guns.

It was confirmed by the inventors of the present invention that a certain type of thermoplastic resin produces not only a gas or gases after decomposition by high temperature heating but also dark brown burnt dregs which can be called as a kind of initial carbide. It was confirmed also that a covering film can be made of a thermoplastic resin productive of such burnt dregs and a thermoplastic resin not productive of such burnt dregs and, when the content ratio of the two types of the thermoplastic resins is properly adjusted, the covering film can permeate moderately into the refractory filler at charging of molten metal into the mold and form a relatively thin shell layer near the surface portion of the refractory filler defining the mold cavity, thereby successfully avoiding production of casting defects such as mold destruction and sand inclusion even after the film has disappeared from the surface of the refractory filler.

It was further confirmed that the above-described effects can be expected when the above-described mixed composition exists in the thickness direction of the covering film. Consequently, such a mixed composition may be made in the form of either a single-layered composite film including a thermoplastic resin productive of burnt dregs and a thermoplastic resin not productive of burnt dregs or a double-layered films one of which is made of a thermoplastic resin productive of burnt dregs and the other of which is made of a thermoplastic resin not productive of burnt dregs.

SUMMARY OF THE INVENTION

It is the primary object of the present invention to provide an improved covering film for casting process by vacuum sealed molding which assures successful casting with remarkably reduced mold destruction and sand inclusion.

It is another object of the present invention to provide improved covering film for casting process by vacuum sealed molding which requires greatly reduced manual operation, is advantageous from the viewpoint of labor hygienics and is well suited for streamlining the whole casting process by mechanization and automation.

It is also the object of the present invention to provide an improved covering film for casting process by vacuum sealed molding which assures highly enhanced quality of cast products.

It is a further object of the present invention to provide improved covering film for casting process by vacuum sealed molding which simplifies production of cast products having complicated surface constructions such as overhangs.

Thus, in accordance with the present invention, the covering films includes 10 to 40 percent by weight of a thermoplastic resin productive of burnt dregs and remaining percent by weight of a thermoplastic resin not productive of burnt dregs.

DESCRIPTION OF PREFERRED EMBODIMENTS

Figure 1:
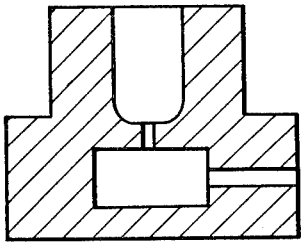

The covering film in accordance with the present invention is, as hereinbefore described, made up of a thermoplastic resin productive of burnt dregs and a thermoplastic resin not productive of burnt dregs.

In this connection, classification of available thermoplastic resins into the above-described two types is made on the basis of the following criterion.

A film made of a certain thermoplastic resin and having a thickness in a range from 10 to 100 micronmeters is used as a test sample and the test sample is held at a position 2 centimeters distant from a molten metal block of 1,400° C. for 10 seconds. When the film is turned into dark brown burnt dregs by the exposure to the molten metal, the thermoplastic resin composing the film is regarded as "productive of burnt dregs". Whereas, when the film is decomposed into a gas or gases, or melts only, the thermoplastic resin composing the film is regarded as "not productive of burnt dregs".

The thermoplastic resin productive of burnt dregs is chosen typically from a group composed of polybutadienes having syndiotactic 1,2-bonds (hereinafter referred to simply as "1,2-polybutadienes"), polyacrylonitriles, polyamides, polyvinyl chlorides, polyvinylidene chlorides and thermoplastic polyester elastomers.

The thermoplastic resin not productive of burnt dregs is chosen typically from a group composed of ionomer resins such as Sarlin produced by Du Pont, polyethylenes, polypropylenes and ethylene-vinyl acetate copolymers. The above-described ionomer resin is an ionic copolymer obtained by ionic-bonding or cross-linking with metallic ions molecular chains of $\alpha$-olefines and copolymerizable unsaturated carboxylic acids such as acrylic acids, methacrylic acids and maleic acids. A preferred combination can be obtained by using 1,2-polybutadienes for the thermoplastic resin productive of burnt dregs and ionomer resins for the thermoplastic resin not productive of burnt dregs.

The content of the thermoplastic resin productive of burnt dregs in the film composition is preferably in a range from 10 to 40 percent by weight. The remainder of the film composition includes the thermoplastic resin not productive of burnt dregs. The remainder of the film composition may include additives such as plasticizer and stabilizers which are in general included in thermoplastic resins.

One embodiment of the covering film of the present invention is given in the form of a single-layered composite film which includes the above-described two types of thermoplastic resins at the above-described content ratio. The other embodiment of the covering film of the present invention is given in the form of double-layered films laminated to each other which are made up of the above-described two types of thermoplastic resins, respectively. That is, when the total thickness of the covering film is 50 micronmeters, the thickness of the film made up of the thermoplastic resin productive of burnt dregs is in a range from 5 to 20 micronmeters whereas that of the film made up of the thermoplastic resin not productive of burnt dregs is in a range from 45 to 30 micronmeters.

In the case of the laminated type two-layered films, either the film made up of the thermoplastic resin productive of burnt dregs or the film made up of the thermoplastic resin not productive of burnt dregs may be in direct contact with the refractory filler when the covering film is set on the pattern surface. In this connection, it is advantageous that the former type film should be in direct contact with the refractory filler since the same forms the relatively thin shell layer in the vicinity of the disappearing cover film.

When the content ratio of the thermoplastic resin productive of burnt dregs falls short of 10 percent by weight, no sufficient prevention of mold destruction and sand inclusion can be obtained. When the content ratio of same exceeds 40 percent by weight, patterning fidelity of the resultant covering film is lowered.

The total thickness of the covering film preferably usable for the present invention is in a range from 30 to 100 micronmeters. If the thickness of the film falls short of 30 micron meters, application of the vacuum suction tends to cause easy breakage of the covering film. Thickness of the covering film exceeding 100 micronmeters may result in an economic disadvantage, increased development of gas defects and production of too much burnt dregs.

The covering film in accordance with the present invention can be produced by any popular process such as the T-die method and the inflation method. The laminated type covering film in accordance with the present invention can also be produced by any popular process such as the two-layered extrusion method, the melt extrusion lamination method by a T-die and the rolling method.

The covering film so obtained in accordance with the present invention is usable for the vacuum sealed molding and casting just as the conventional covering films.

As is clear from the foregoing description, employment of the present invention assures the following advantages.

(a) The casting process can be carried out almost ideally while causing reduced mold destruction, sand inclusion, texture degradation and generation of gas defects.

(b) When compared with the thermosetting resin initial condensate coating, the process excellently meets hygienic requirements and is well suited for streamlining of the whole process by mechanization and automation with no uneven coating.

The following examples are illustrative of the present invention, but are not to be construed as limiting the same.

EXAMPLE 1

Sarlin produced by Du Pont was used as the ionomer resin and JSR RB 820 produced by Japan Synthetic Rubber Co. Ltd. was used as the 1,2-polybutadiene. The latter includes 90 percent by weight or more of 1,2-bonds and the softening point of the same is 52° C.

For 100 parts by weight of the ionomer resin, 5, 9, 11, 25, 43, 67, 82 and 100 parts by weight of the 1,2-polybutadiene was blended in order to obtain pellet-state mixtures including 5, 8, 10, 20, 30, 40, 45 and 50 percent by weight of the 1,2-polybutadiene, respectively.

The pellet-state mixtures were subjected to the inflation method under the following process conditions in order to obtain covering films of 40 micronmeters, respectively.

Temperature of the cylinder; 190° C.
Temperature of the die; 185° C.
Temperature of the resins; 220° C.
Take-up speed; 12 m/min.

The following function tests were carried out using the above-described test samples.

(A) Patterning fidelity

Each of the test samples was heated at a position 15 cm. distant from a far infrared rays panel heater of 400° C. for prescribed length of periods and, after the heating, placed on a metallic mold having a hollow as shown in FIG. 1 of 41.5 mm. internal diameter. Vacuum suction of 500 Torr. was applied to the film from the hollow bottom of the metallic mold and the maximum patterning depth of the film without any breakage was measured.

Figure 2:
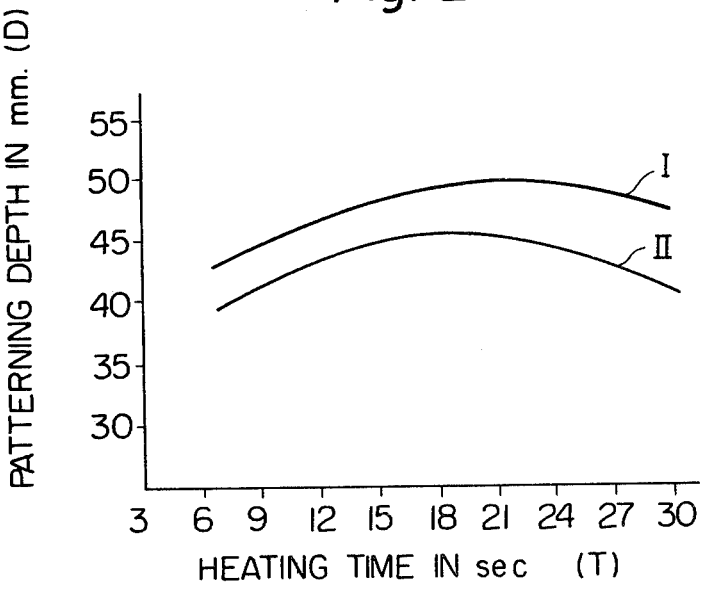

The relationship between the patterning depth D in mm. and the heating time in sec. (T) is graphically shown in FIG. 2, in which the curve I corresponds to the test sample containing 20 percent by weight of 1,2-polybutadiene and the curve II corresponds to the test sample containing 100 percent by weight of 1,2-polybutadiene. It is clear from the illustration that the patterning fidelity possessed by the film in accordance with the present invention, i.e. the test sample corresponding to the curve I, is better than that of the 100% 1,2-polybutadiene film.

(B) Thermal perforation

Figure 3:
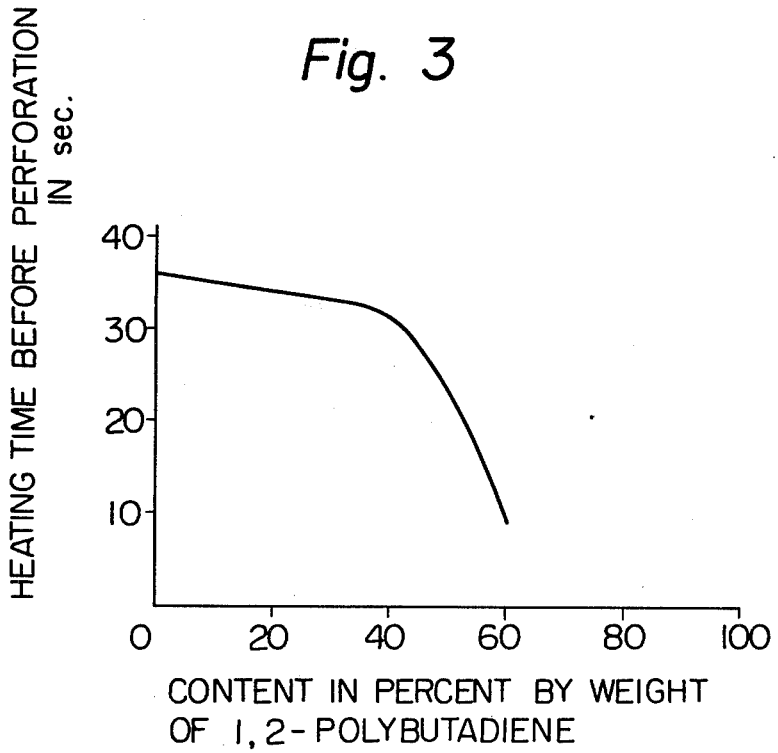

Each of the test samples was heated at a position 15 cm. distant from a far infrared rays panel heater of 400° C. and the length of the heating time before development of any perforation in the test sample was measured. The length of this heating time is used as a criterion for appreciation of the patterning fidelity of the test sample, i.e. the possibility of the deep vacuum suction of the covering film upon the pattern surface without causing any film breakage. The relationship between the content of the 1,2-polybutadiene and the heating time before the film breakage is graphically shown in FIG. 3. It is clear from the illustration that the content of the 1,2-polybutadiene up to 40 percent by weight brings about long heating time before film breakage, i.e. patterning fidelity.

(C) Adaptability to casting

Each of the test samples was set by vacuum suction onto a mold made up of three rectangular blocks of 100 mm. width, 300 mm. length and 10 mm. thickness. Vacuum sealed molding was carried out using a refractory filler of 200 meshes and molten metal of 1,400° C. was charged into the obtained complete mold. The results of the measurement are shown in Table 1.

Table 1

| Content in percent by weight of 1,2-polybutadiene | Casting defects | |
|---|---|---|
| | Texture degradation* | Carbon dregs on the shaved surface of the cast product** |
| 0 | BAD | 20 |
| 5 | BAD | 5 |
| 8 | NOT BAD | 4 |
| 10 | NOT BAD | 2 |
| 20 | GOOD | 1 |
| 30 | GOOD | 1 |
| 40 | GOOD | 3 |
| 45 | GOOD | 4 |
| 50 | GOOD | 7 |
| 100 | BAD | 30 |

NOTE;
*Appreciation of the texture degradation of the castproduct was carried out on the basis of the following criteria.
BAD. . .The texture of the cast product is clearly damaged by the molten metal charging.
NOT BAD. . .The texture of the cast product is somewhat damaged by the molten metal charging.
GOOD. . .The texture of the cast product is very smooth. Only very careful observation can reveal the little trace of the molten metal stagnation at charging.
**The surface of the cast product corresponding to the moldcavity wall was shaved over about 1 mm. depth. The number ofthe unburnt dregs generated by the film portions contained inthe cast product was counted.

EXAMPLE 2

Similar tests were carried out for test samples of different combinations of the two types of thermoplastic resins and the results are shown in Tables 2 and 3.

In the following tables, the symbol "X" corresponds to the above-described appreciation "BAD", the symbol "Δ" corresponds to the above-described appreciation "NOT BAD" and the symbol "O" corresponds to the above-described appreciation "GOOD".

Table 2

| Texture degradation | | | | | | | | | |
|---|---|---|---|---|---|---|---|---|---|
| Thermoplastic resin | | Content in percent by weight of the thermoplastic resin productive of burnt dregs | | | | | | | |
| productive of burnt dregs | not productive of burnt dregs | 5 | 8 | 10 | 20 | 30 | 40 | 45 | 50 |
| 1,2-polybutadien | Polypropylene | X | X | Δ | O | O | O | O | O |
| 1,2-polybutadiene | Ethylene-vinyl acetate copolymer | X | X | Δ | O | O | O | O | O |
| Polyamide | Ionomer | X | Δ | O | O | O | O | O | O |
| Polyamide | Polyethylene | X | X | Δ | O | O | O | O | O |
| Polyvinylidene chloride | Ionomer | X | Δ | O | O | O | O | O | O |
| Polyester elastomer | Ethylene-Vinyl acetate copolymer | X | Δ | O | O | O | O | O | O |

It will be clear from the results shown in the table that, as far as the texture degration is concerned, better results can be obtained when the content of the thermoplastic resin productive of burnt dregs is 10 percent by weight or larger.

Table 3

| Carbon dregs on the shaved surface. | | | | | | | | | |
|---|---|---|---|---|---|---|---|---|---|
| Thermoplastic resin | | Content in percent by weight of the thermoplastic resin productive of burnt dregs | | | | | | | |
| productive of burnt dregs | not productive of burnt dregs | 5 | 8 | 10 | 20 | 30 | 40 | 45 | 50 |
| 1,2-polybutadiene | Polypropylene | 7 | 5 | 2 | 2 | 2 | 3 | 5 | 9 |
| 1,2-polybutadiene | Ethylene-vinyl acetate copolymer | 6 | 4 | 2 | 1 | 1 | 3 | 4 | 8 |
| Polyamide | Ionomer | 5 | 4 | 1 | 1 | 1 | 2 | 3 | 6 |
| Polyamide | Polyethylene | 8 | 7 | 3 | 3 | 3 | 3 | 4 | 9 |
| Polyvinylidene chloride | Ionomer | 6 | 6 | 3 | 2 | 2 | 3 | 6 | 10 |
| Polyester elastomer | Ethylene-vinyl accetate copolymer | 5 | 4 | 2 | 1 | 1 | 2 | 4 | 6 |

It is learned from the results given in the table that, as concerns the carbon dregs, preferable results can be obtained when the content of the thermoplastic resin productive of burnt dregs is in a range from 10 to 40 percent by weight.

We claim:

1. Improved covering film of at least 30 micron meters thickness for casting process by vacuum sealed molding comprising at least 10% by weight of a thermoplastic resin productive of burnt dregs and a thermoplastic resin not productive of burnt dregs.

2. Improved covering film as claimed in claim 1 in which the content ratio of said thermoplastic resin productive of burnt dregs is in a range from 10 to 40 percent by weight.

3. Improved covering film as claimed in claim 2 in which the total thickness of said covering film is in a range of from 30 to 100 micronmeters, said thermoplastic resin productive of burnt dregs comprises 1,2-polybutadiene and said thermoplastic resin not productive of burnt dregs comprises ionomer resin.

4. Improved covering film as claimed in claims 1 or 2 in which said thermoplastic resin productive of burnt dregs is chosen from the group consisting of 1,2-polybutadienes, polyacrylonitriles, polyamides, polyvinyl chlorides, polyvinylidene chlorides and thermoplastic polyester elastomers.

5. Improved covering film as claimed in claims 1 or 2 in which said thermoplastic resin not productive of burnt dregs is chosen from the group consisting of ionomer resins, polyethylenes, polypropylenes and ethylene-vinyl acetate copolymers.

6. Improved covering film as claimed in claims 1 or 2 in which said covering film is in the form of a single layered composite film containing said both types of thermoplastic resins together.

7. Improved covering film as claimed in claims 1 or 2 in which said covering film is in the form of a double-layered laminated film, one layer including one of said two types of thermoplastic resins, and the other film including the other of said two types of thermoplastic resins, respectively.

8. Improved covering film as claimed in claims 1 or 2 in which the total thickness of said covering film is in a range from 30 to 100 micronmeters.

* * * * *